US010588484B2

(12) United States Patent
Chan

(10) Patent No.: US 10,588,484 B2
(45) Date of Patent: Mar. 17, 2020

(54) DRYING RACK

(71) Applicant: Munchkin, Inc., Van Nuys, CA (US)

(72) Inventor: Sung Yun Chan, Pasadena, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 15/213,060

(22) Filed: Jul. 18, 2016

(65) Prior Publication Data

US 2017/0014016 A1 Jan. 19, 2017

Related U.S. Application Data

(60) Provisional application No. 62/194,083, filed on Jul. 17, 2015.

(51) Int. Cl.
*A47L 19/04* (2006.01)
*A47F 5/04* (2006.01)

(52) U.S. Cl.
CPC ..... *A47L 19/04* (2013.01); *A47F 5/04* (2013.01)

(58) Field of Classification Search
CPC ..... A47L 19/00; A47L 19/04; A47G 19/00; A47G 19/22; B65F 85/73; A47F 5/04
USPC ..... 211/41.6
See application file for complete search history.

(56) References Cited

U.S. PATENT DOCUMENTS 712,428 A * 10/1902 Whitcomb ..... A47B 81/005 211/64
978,670 A * 12/1910 Solomon ..... A47F 5/02 211/163
1,257,107 A * 2/1918 Patterson ..... A47B 81/005 211/107
2,883,063 A * 4/1959 Baren ..... B01L 9/00 211/78
2,946,456 A * 7/1960 Liguori ..... A47F 7/283 211/77
2,967,622 A * 1/1961 Poglein ..... A47G 23/0208 211/41.2
3,529,742 A * 9/1970 Cumming ..... A47L 15/502 134/84
3,613,901 A * 10/1971 Montelius ..... A47F 5/05 211/166
4,334,623 A * 6/1982 Geary ..... A47G 23/0208 211/131.1
D342,191 S * 12/1993 Cronk ..... D7/706
5,392,923 A * 2/1995 Hassard ..... A47F 10/00 108/96
5,425,460 A * 6/1995 Barbarian ..... A47B 49/00 211/129.1

(Continued)

FOREIGN PATENT DOCUMENTS

AU 2014101282 A4 * 11/2014
KR 2014101641 A * 8/2014

*Primary Examiner* — Ko H Chan
(74) *Attorney, Agent, or Firm* — Robert Z. Evora, Esq.

(57) ABSTRACT

A drying rack assembly having a first drying rack, a utensil bin, a support that connects the utensil bin to the first drying rack, and an elevated foundation which promotes air ventilation throughout the drying rack. The first drying rack includes an integrated clamp and a collapsible peg that secures objects in place. The utensil bin is a cylindrical sleeve having guided projections that connects to the support located on the first drying rack. At least one aperture is located on the support to provide proper drainage for items placed inside the utensil bin.

16 Claims, 19 Drawing Sheets

(56) References Cited

U.S. PATENT DOCUMENTS

| | | | | | |
|---|---|---|---|---|---|
| 5,590,804 | A * | 1/1997 | Crum | A47J 47/20 | 220/23.86 |
| 6,491,170 | B1 * | 12/2002 | Madela | A47L 19/04 | 211/41.3 |
| D504,284 | S * | 4/2005 | Corona | D7/600.4 | |
| D561,541 | S * | 2/2008 | Stephen | D7/707 | |
| D618,525 | S * | 6/2010 | Garnero | D7/706 | |
| 8,573,410 | B2 * | 11/2013 | Chalifoux | A47J 47/005 | 211/41.5 |
| 8,915,391 | B2 * | 12/2014 | Radow | A47G 19/00 | 108/139 |
| 8,925,743 | B1 * | 1/2015 | Lee | A47L 19/04 | 211/41.6 |
| 2008/0061186 | A1 * | 3/2008 | Nip | A47K 10/3836 | 242/597.7 |
| 2013/0111779 | A1 * | 5/2013 | Lee | F26B 20/00 | 34/275 |

* cited by examiner

DRYING RACK

CROSS REFERENCE TO RELATED APPLICATION

This application claims priority to U.S. Provisional Patent Application Ser. No. 62/194,083, filed Jul. 17, 2015; the contents of which are hereby incorporated by reference herein in their entirety into this disclosure.

TECHNICAL FIELD

The subject disclosure relates to a drying rack. More particularly, to a high capacity drying rack having a utensil bin, drying slots for straws, nipples, valves, pacifiers and other bottles, cups and accessories, and a reversible drip tray.

BACKGROUND

Various types of drying racks are known. After various containers, dishes, bottles, straws, valves, pumps, nipples, pacifiers, or other accessories are washed they are typically placed on a drying rack to allow items to dry and for the extra water to drain. Often these items have a wide variety of shapes and sizes. Consequently, organizing these various items can be quite challenging. Additionally, the items have limited drying positions and are oriented in a manner such that water will pool instead of being drained. As a result, various containers and accessories are not efficiently dried.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Particular embodiments of the present invention will now be described in greater detail with reference to the figures.

Figure 1:
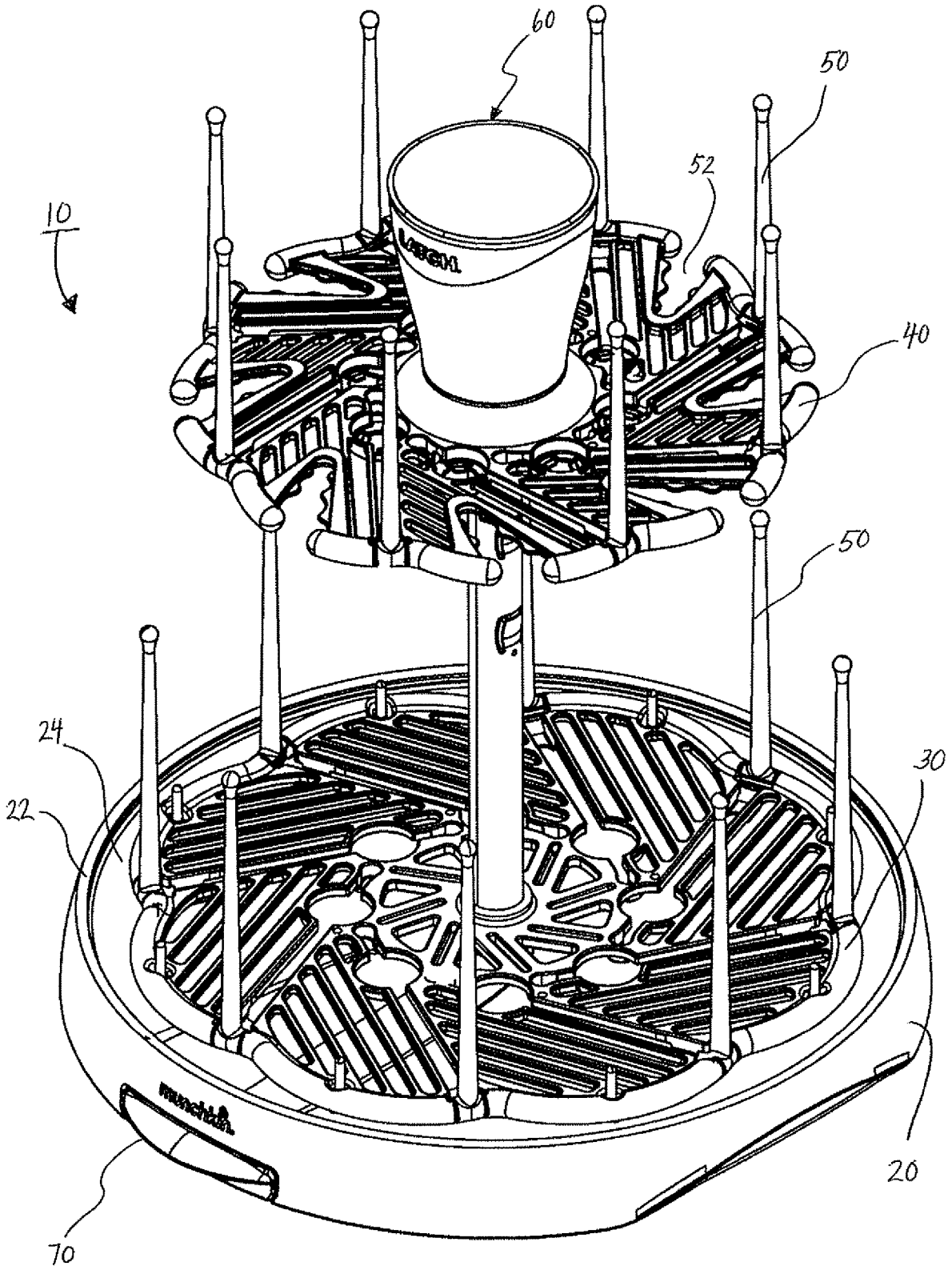
FIG. 1 illustrates an upper perspective view of an exemplary drying rack assembly having a utensil bin, top drying rack, bottom drying rack and tray according to the subject disclosure.

FIG. 1 illustrates an upper perspective view of a drying rack assembly 10. The drying rack assembly 10 includes a base 20, bottom drying rack 30, top drying rack 40, at least one clamp 52, utensil bin 60 and reversible drip tray 70. Various items can be used with the drying rack assembly 10, including but not limited to for example, bottles, cups, dishes, valves, straws, nipples, pump accessories, pacifiers, collars, utensils, or other container or tool.

The drying rack assembly 10 may be configured in any size or shape. As shown, the base 20, bottom drying rack 30 and top drying rack 40 are generally circular. The top drying rack 40 includes a support 82 to provide elevated foundation for optimal air ventilation when items are placed therein. The elevated foundation is displaced by a predetermined amount from the bottom drying rack 30 and may be adjusted using a height adjustment mechanism 80 on the support 82 which will be discussed in detail below. The racks 30, 40 may be referred to as first, second, upper, lower or the like.

The base 20 may include a lip 22 disposed circumferentially around the top surface 24 of the base 20. As liquid drips off of the various items being stored within the drying rack assembly 10, it will collect on the top surface 24 and eventually evaporate. The lip 22 will prevent the liquid from overflowing. In addition, instead of a lip 22, the top surface 24 may be slanted, conical, frustoconical, or any other suitable shape to facilitate effective drainage of liquid.

The base 20 may further include an aperture 26 (See FIG. 4) on its side adapted to receive the reversible drip tray 70. Depending on how the reversible drip tray 70 is configured, water stored on the top surface 24 may drain through aperture 26, over the reversible drip tray 70 and into a sink or other suitable draining area. This will be shown in greater detail below.

Figure 2:
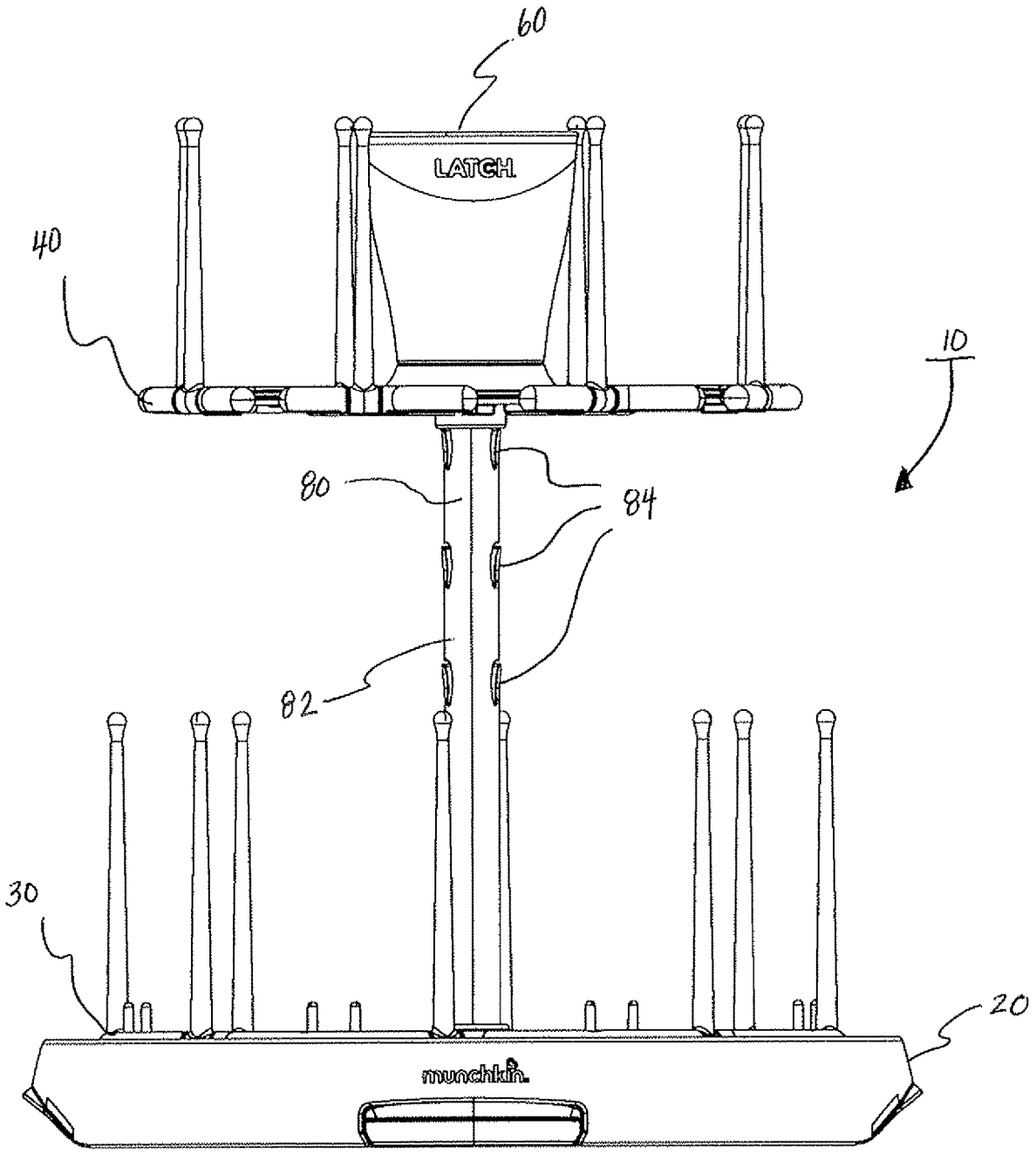
FIG. 2 shows a front view of the drying rack assembly.
Figure 3:
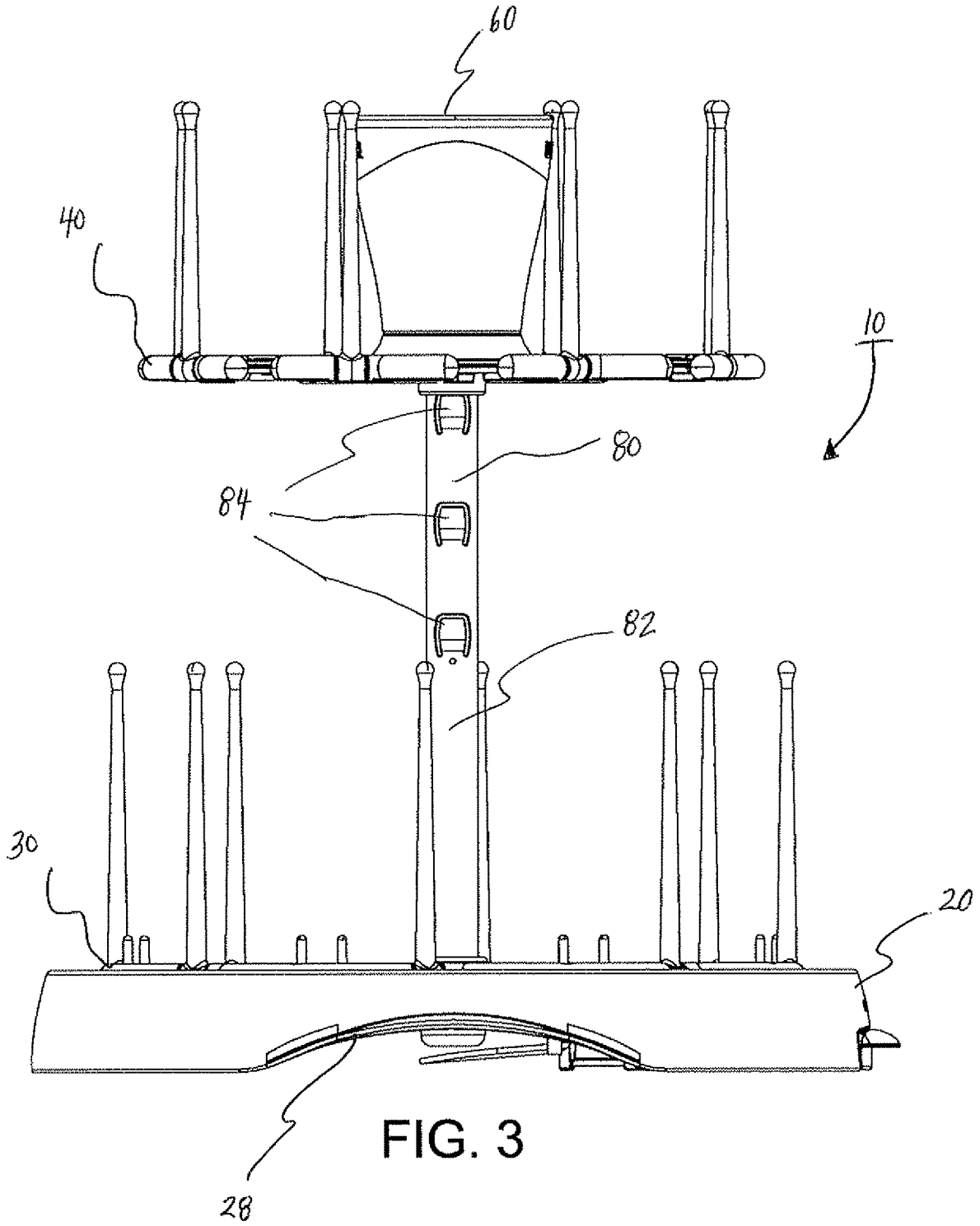
FIG. 3 depicts a side view of the drying rack assembly.
Figure 4:
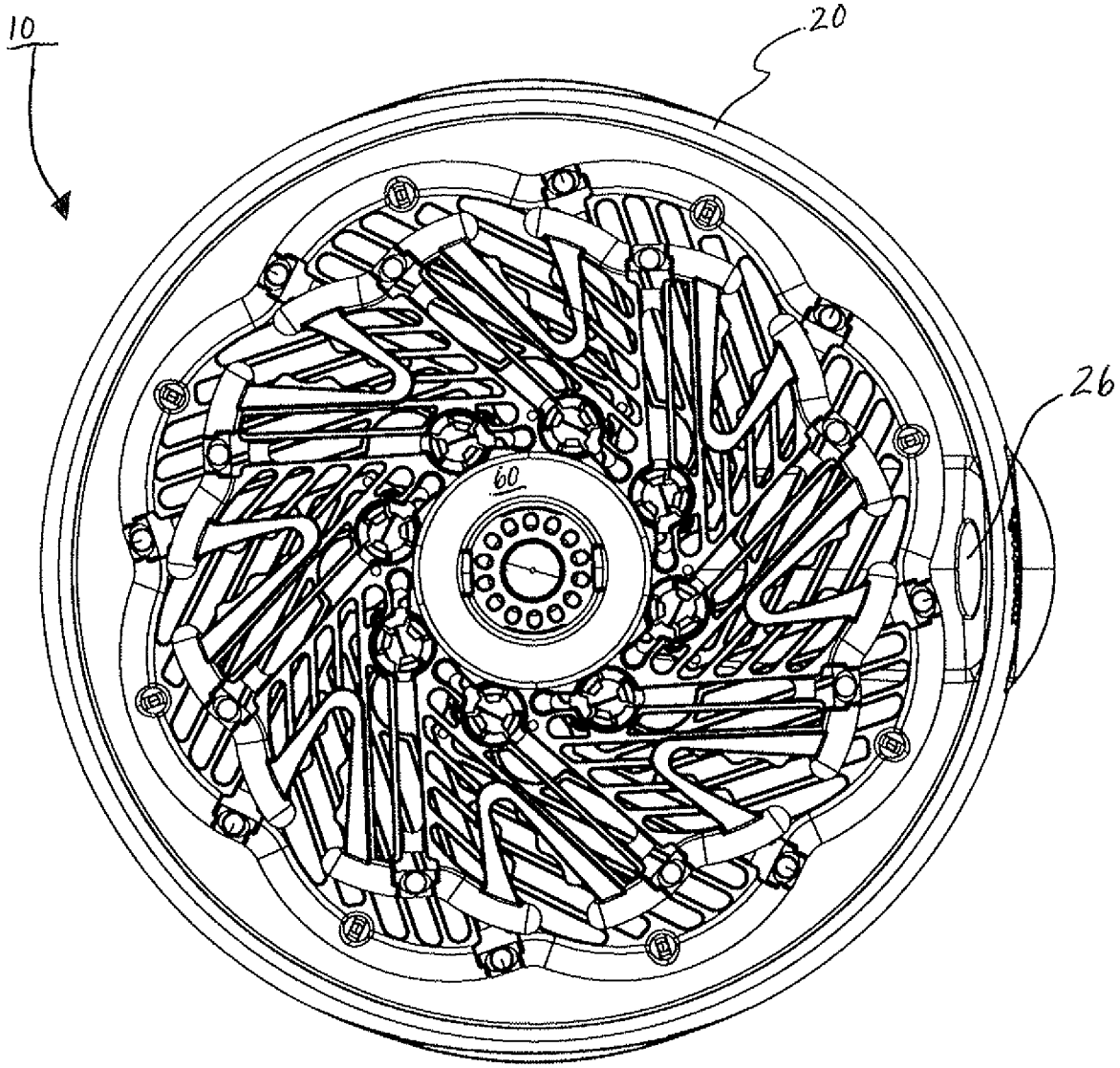
FIG. 4 illustrates a top view of the drying rack assembly.

FIGS. 2-4 depict front, side and top pan views of the drying rack assembly respectively. The bottom drying rack 30 sits on top of the base 20 and is spaced by a predetermined distance upward from the base 20 to facilitate drying of various items placed upon it. The base 20 may also include ridges 28 or scalloped openings, as shown in FIG. 3. The ridges 28 may be used as handles to more easily move the drying rack assembly 10.

Figure 5:
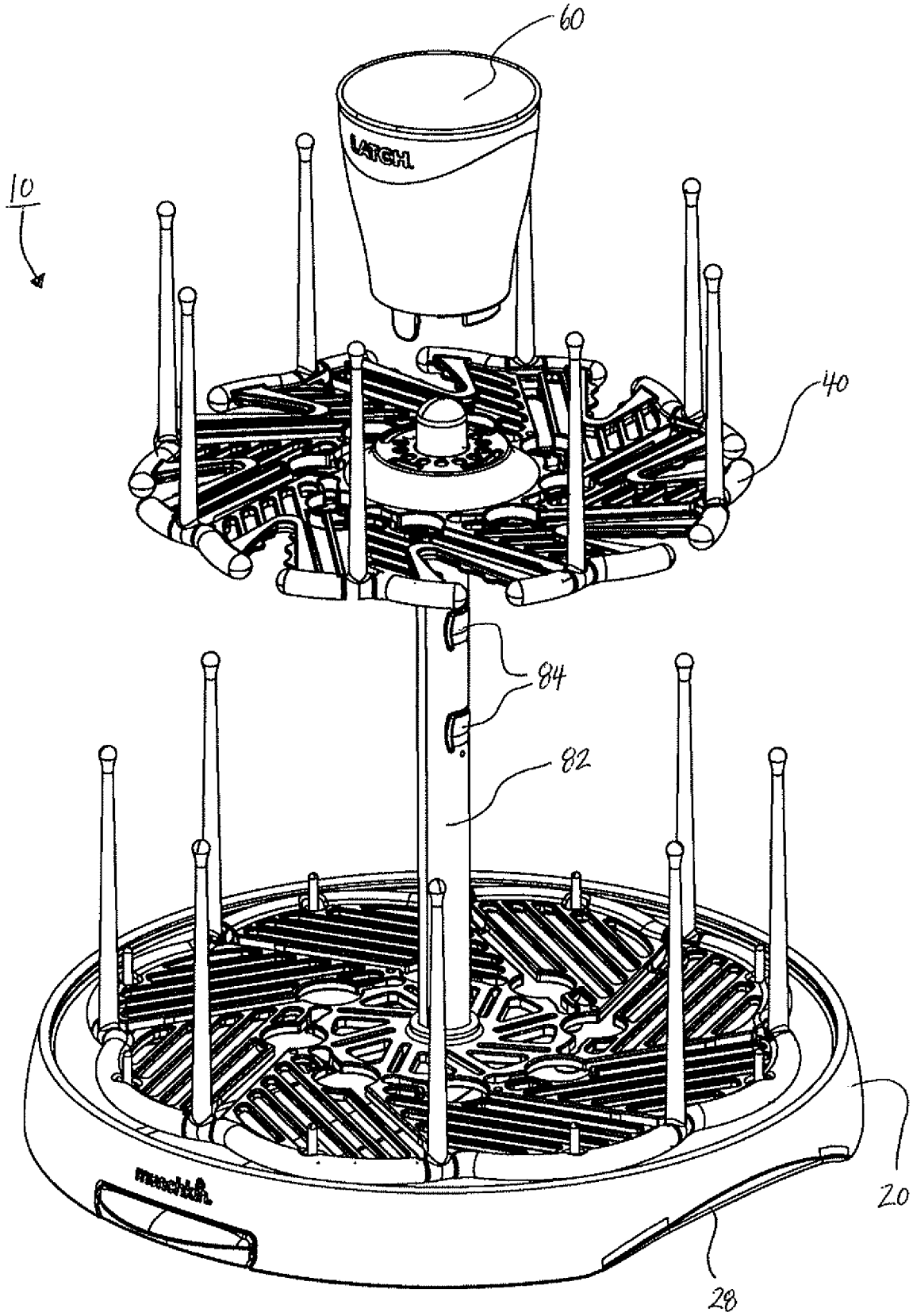
FIG. 5 shows a partially exploded view of the drying rack assembly having the utensil bin lifted off from the top drying rack.
Figure 6:
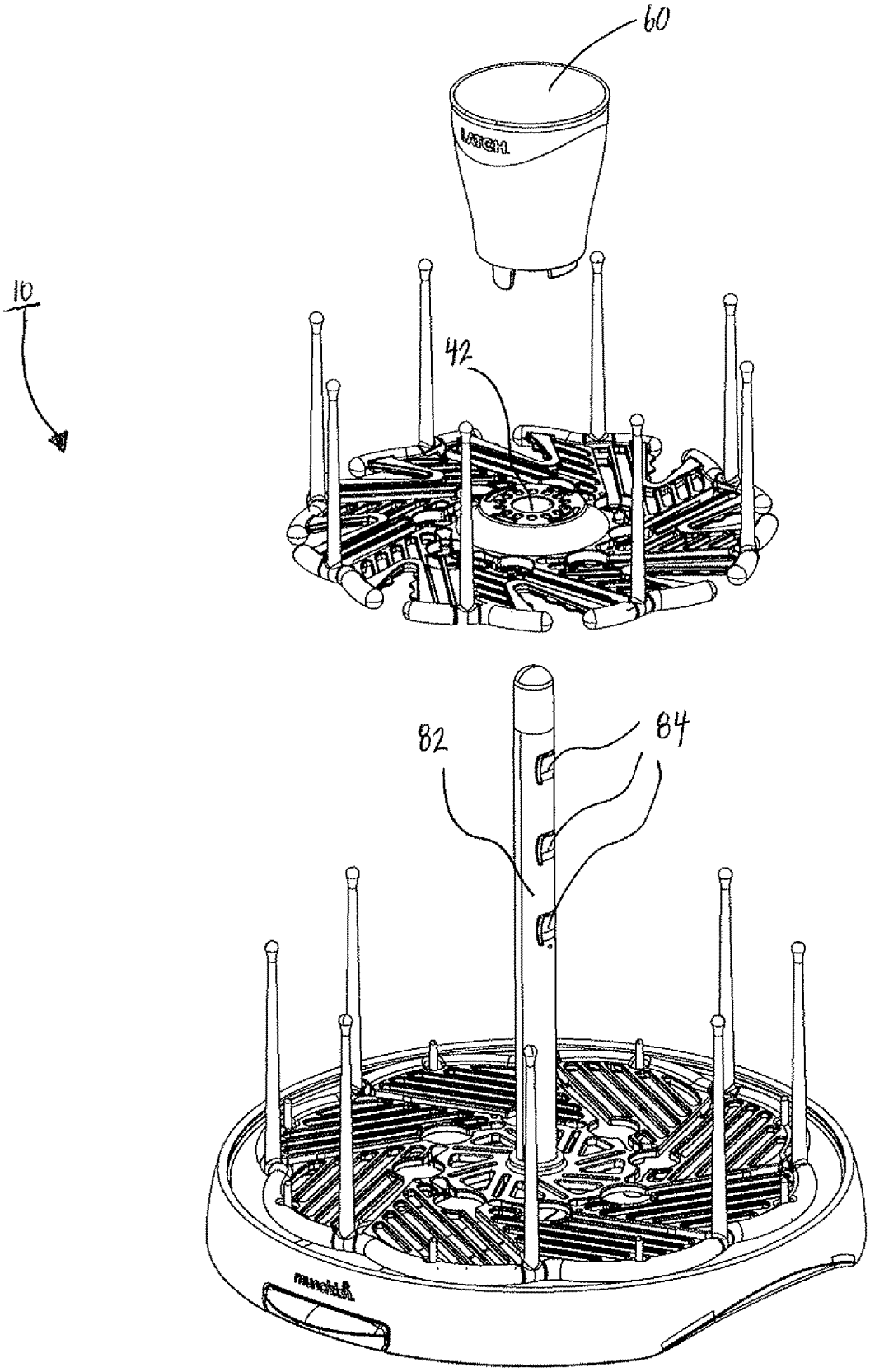
FIG. 6 depicts another exploded view of the drying rack assembly.
Figure 7:
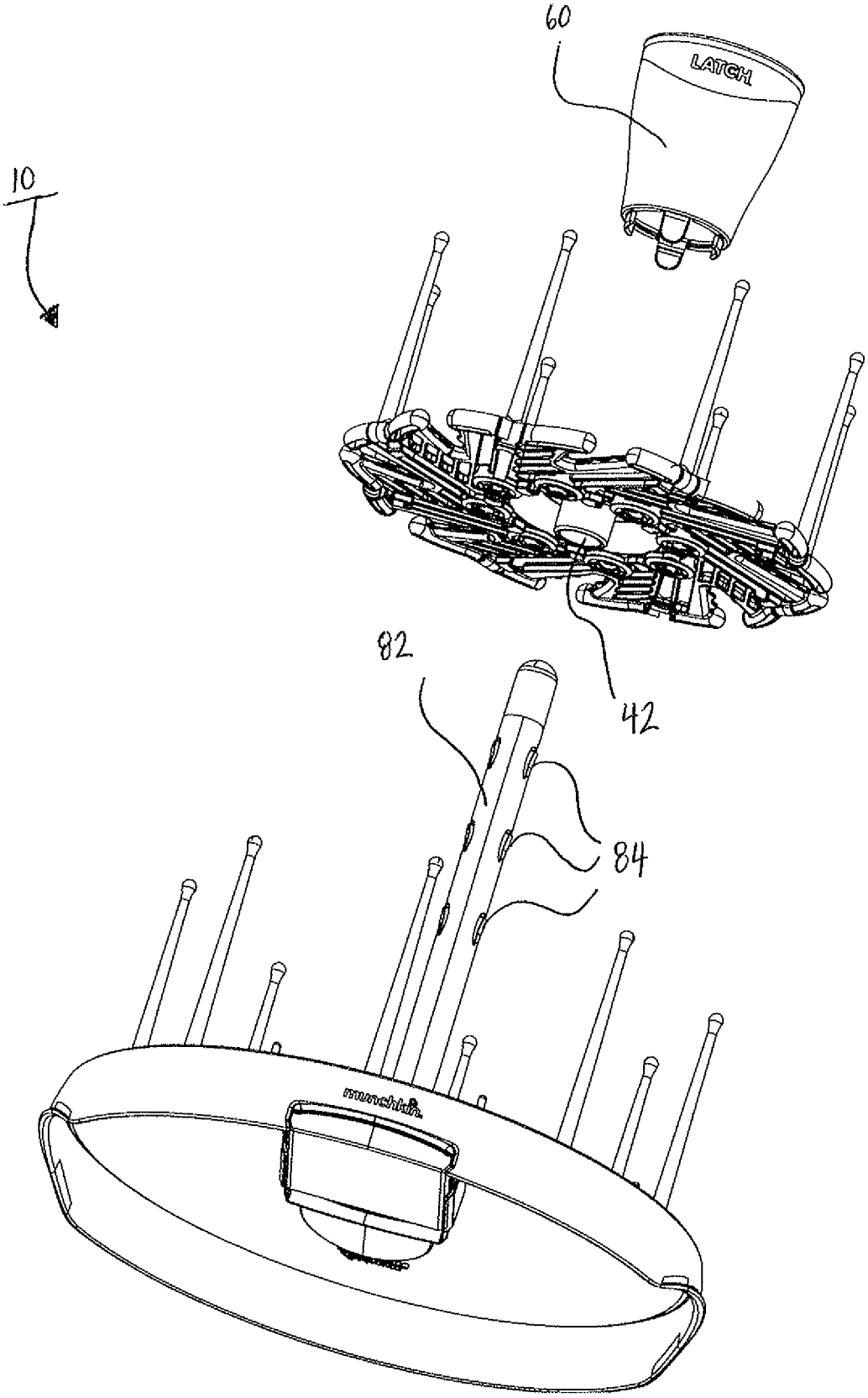
FIG. 7 illustrates a lower perspective exploded view of the drying rack assembly.
Figure 8:
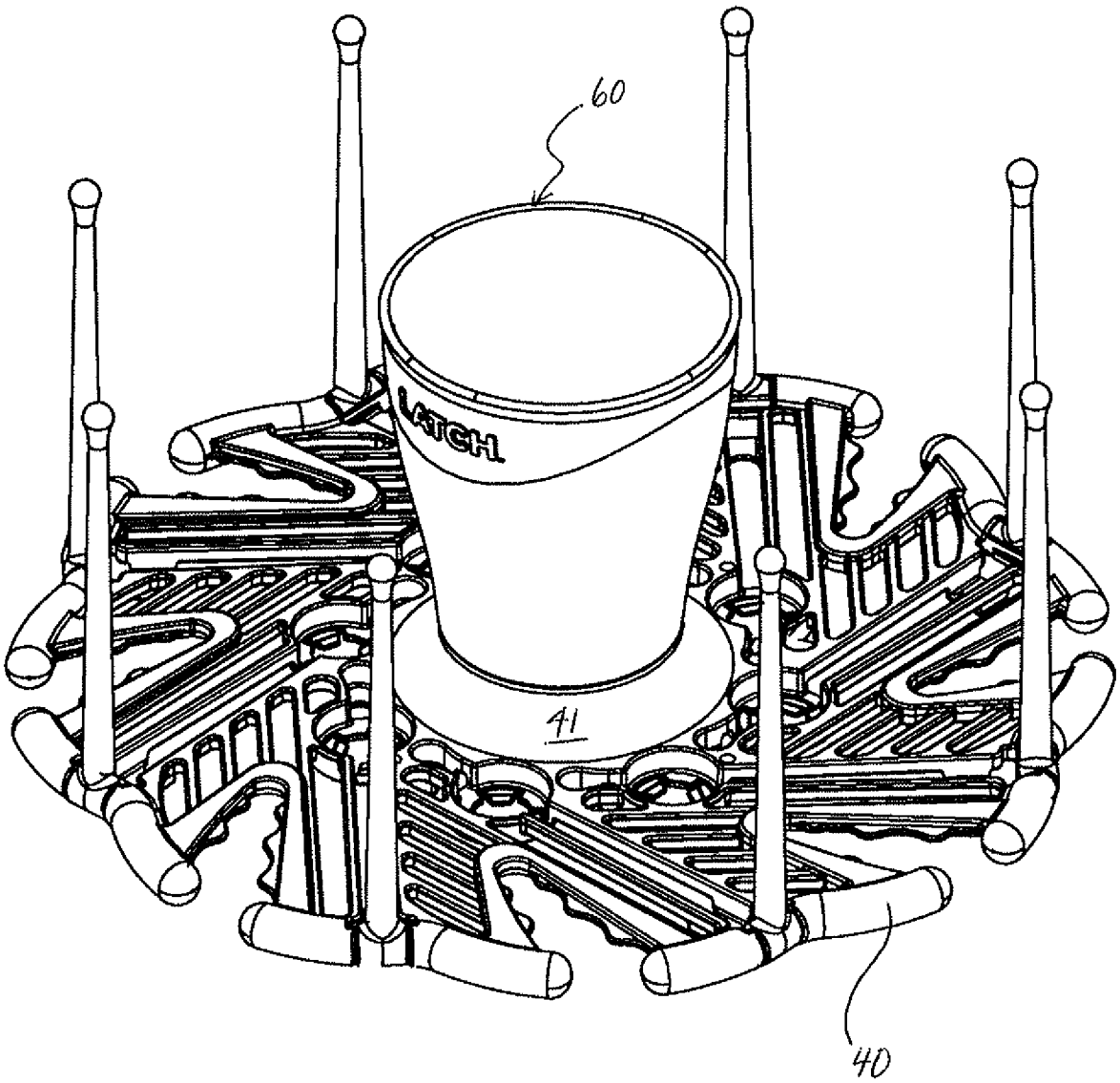
FIG. 8 shows an upper perspective view of the utensil bin and top drying rack.

FIGS. 5-7 illustrate various exploded views of the drying rack assembly 10. A support 82 connects the base 20 to the top drying rack 40. The support 82 may be attached to the base 20 and top drying rack 40 through a threaded connection, friction fit, snap fit, or any other suitable method of securing. As shown, the top drying rack 40 rests upon at least one push tabs 84 of the support 82. The support 82 may take a variety of different shapes or may be cylindrical as shown, which allows the top drying rack 40 to rotate or freely spin about a central axis to gain greater access to items drying at various locations around the drying rack assembly 10.

The height adjustment mechanism 80 comprises multiple push tabs 84 at various heights along the support 82. As a user depresses the push tab 84 towards the center of the support 82, the overall diameter of the support 82 at the location of the push tab 84 will decrease until it is less than the inner diameter of an aperture 42 in the top drying rack 40. At this point, the top drying rack 40 may slide over the push tabs 84 until it reaches another undepressed push tab 84. An advantage of adjusting the height of top drying rack 40 is to allow for different size bottles, dishes or other items stored between the bottom drying rack 30 and the top drying rack 40. The user may minimize the amount of space taken up by the drying rack assembly 10 for his specific need.

Figure 12:
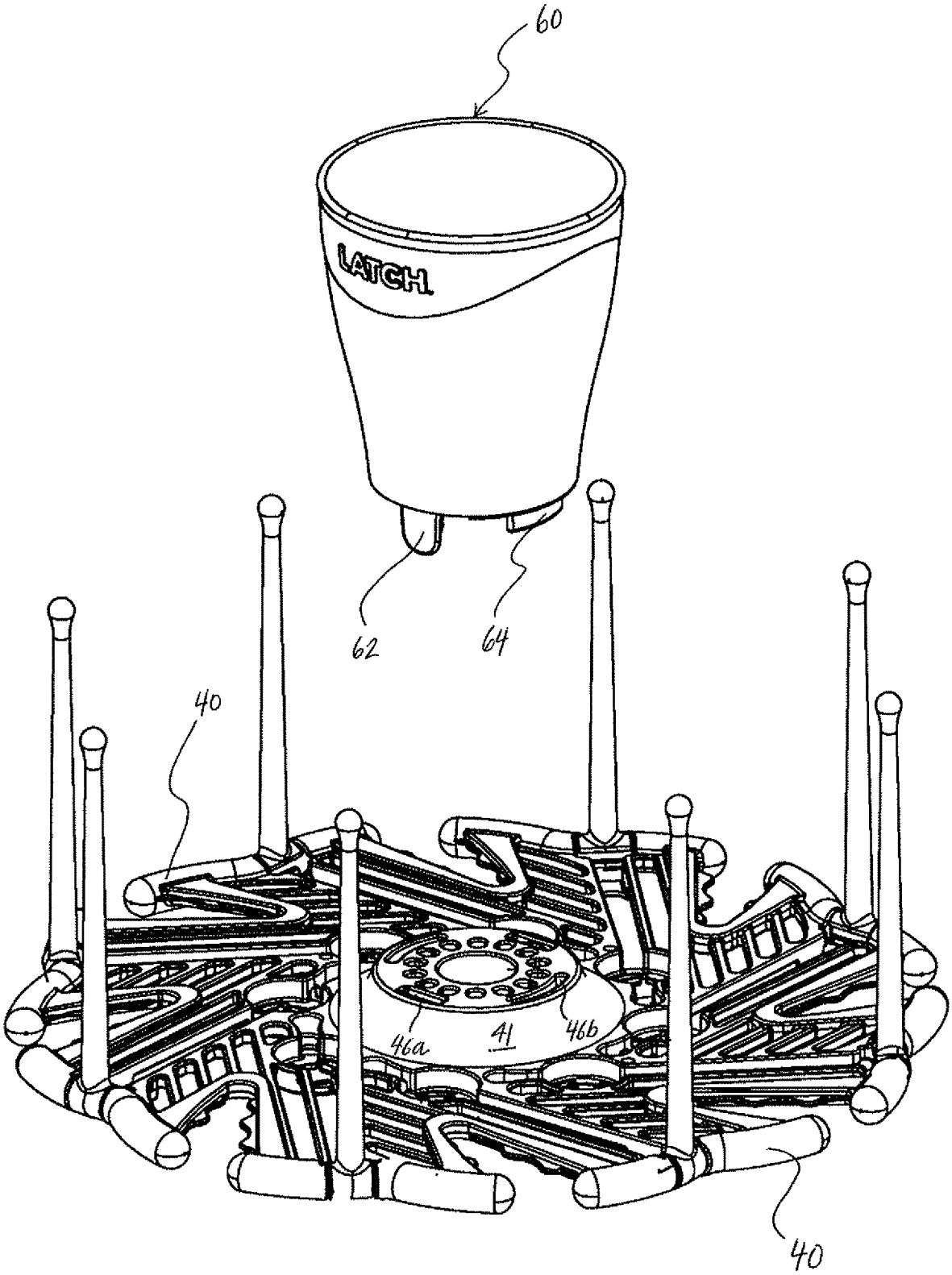
FIG. 12 depicts an exploded view of the utensil bin and top drying rack.
Figure 13:
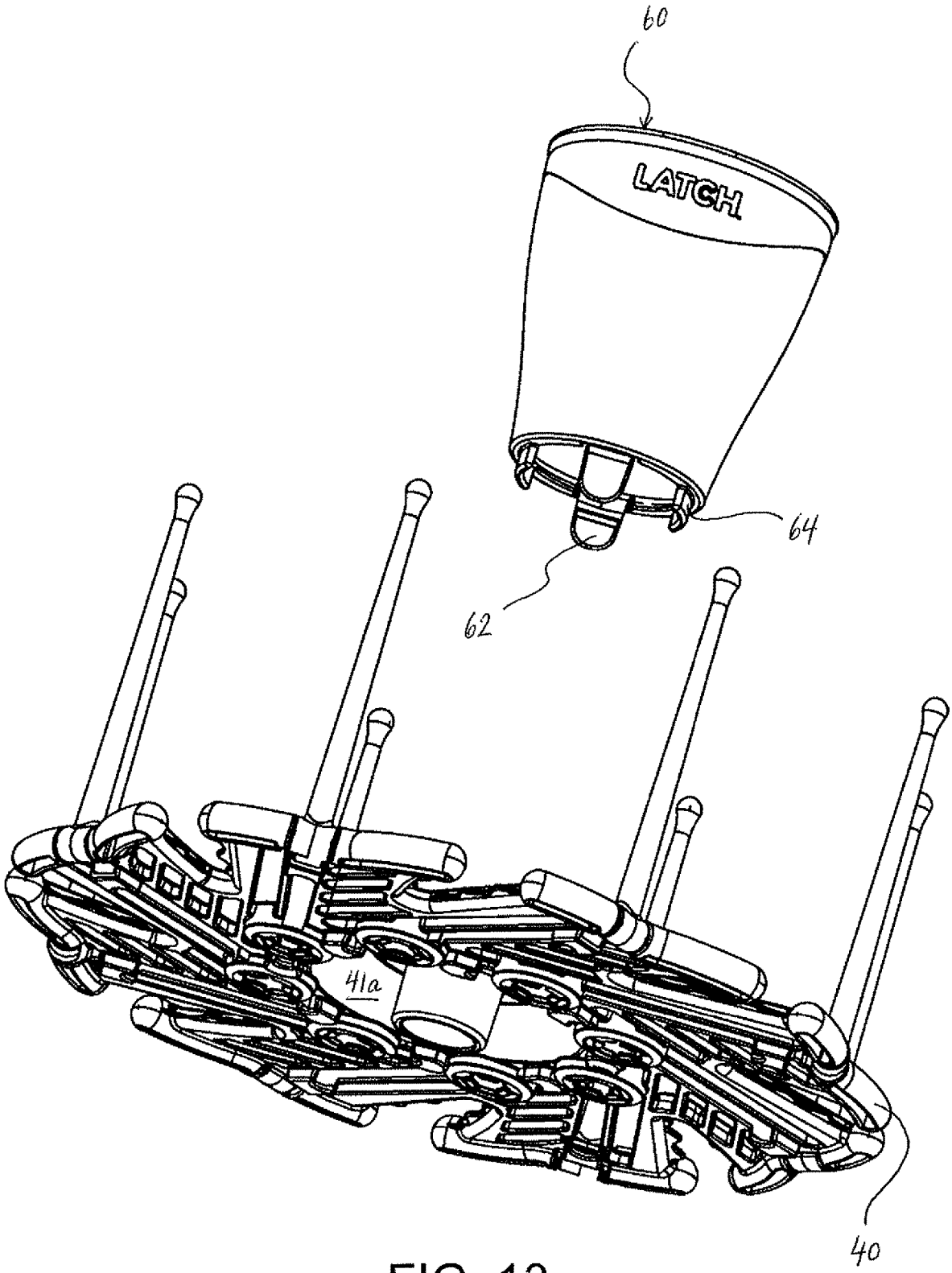
FIG. 13 illustrates a lower perspective exploded view of the utensil bin and top drying rack.

FIGS. 8-13 show various views of the utensil bin 60 and top drying rack 40. The utensil bin 60 may be included to store various spoons, forks, knives, sparks or other utensils while drying. The connected utensil bin 60 has an open top to provide easy access to any items stored therein. The utensil bin 60 may be frustoconical, have a cylindrical sleeve, or may be any other suitable size or shape to keep stored utensils upright while drying. As shown in FIG. 13, the utensil bin 60 may be removable and may include at least one locking tab 62 to connect the utensil bin 60 to the top drying rack 40.

Figure 9:
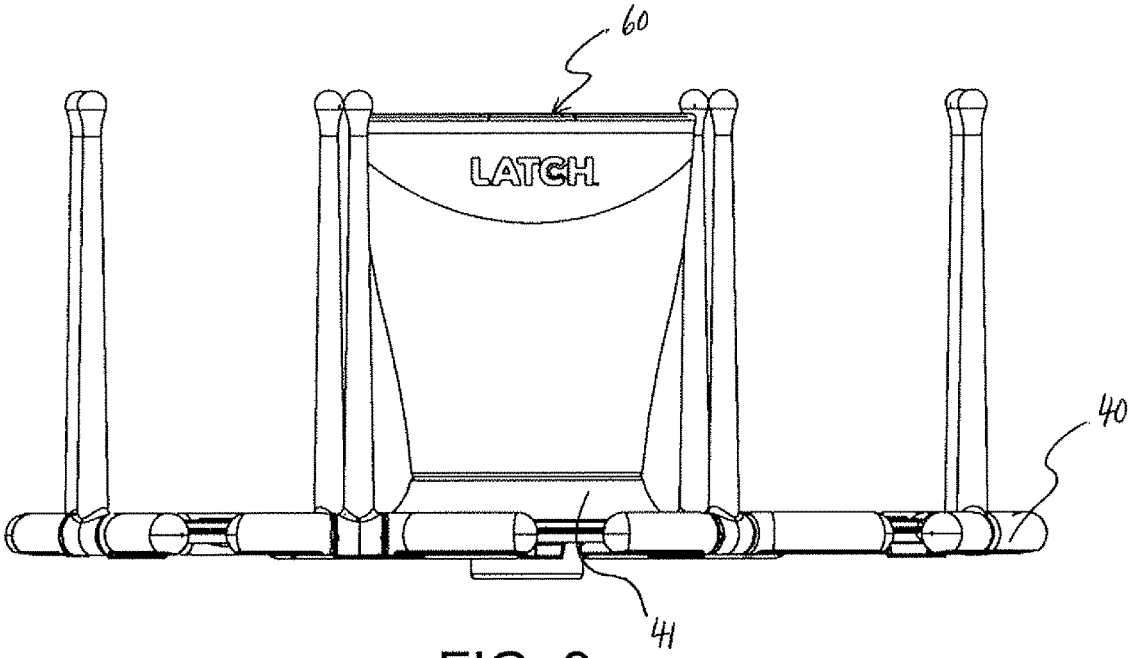
FIG. 9 depicts a front view of the utensil bin and top drying rack.
Figure 10:
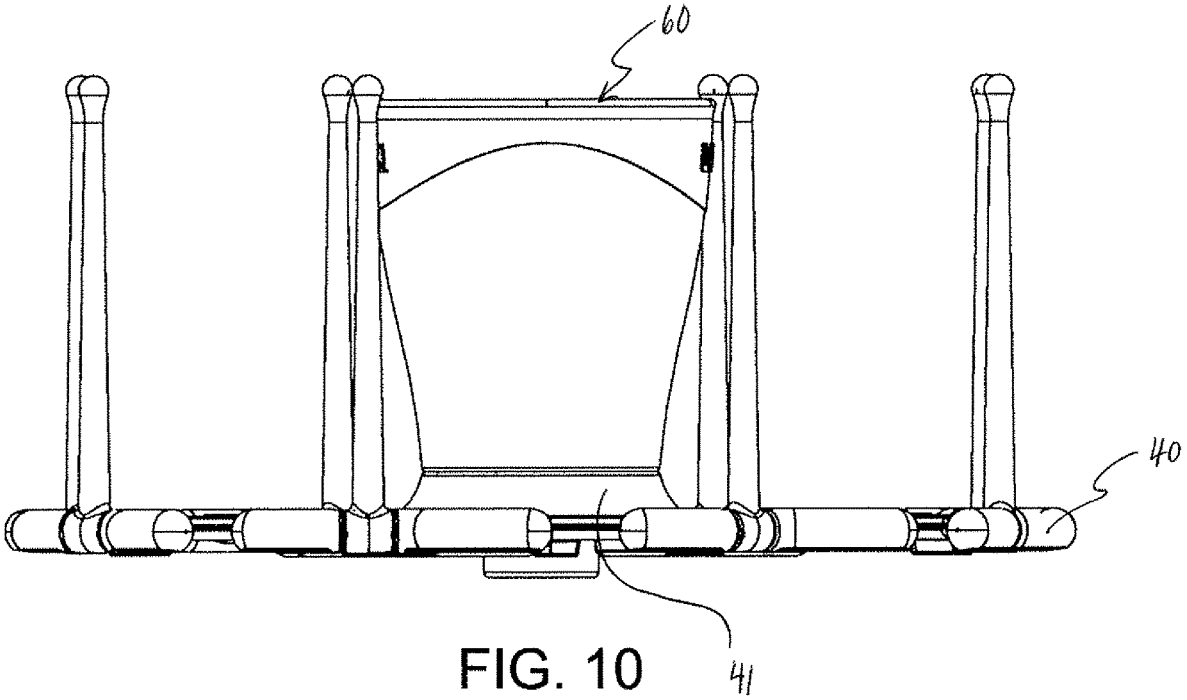
FIG. 10 illustrates a side view of the utensil bin and top drying rack.
Figure 11:
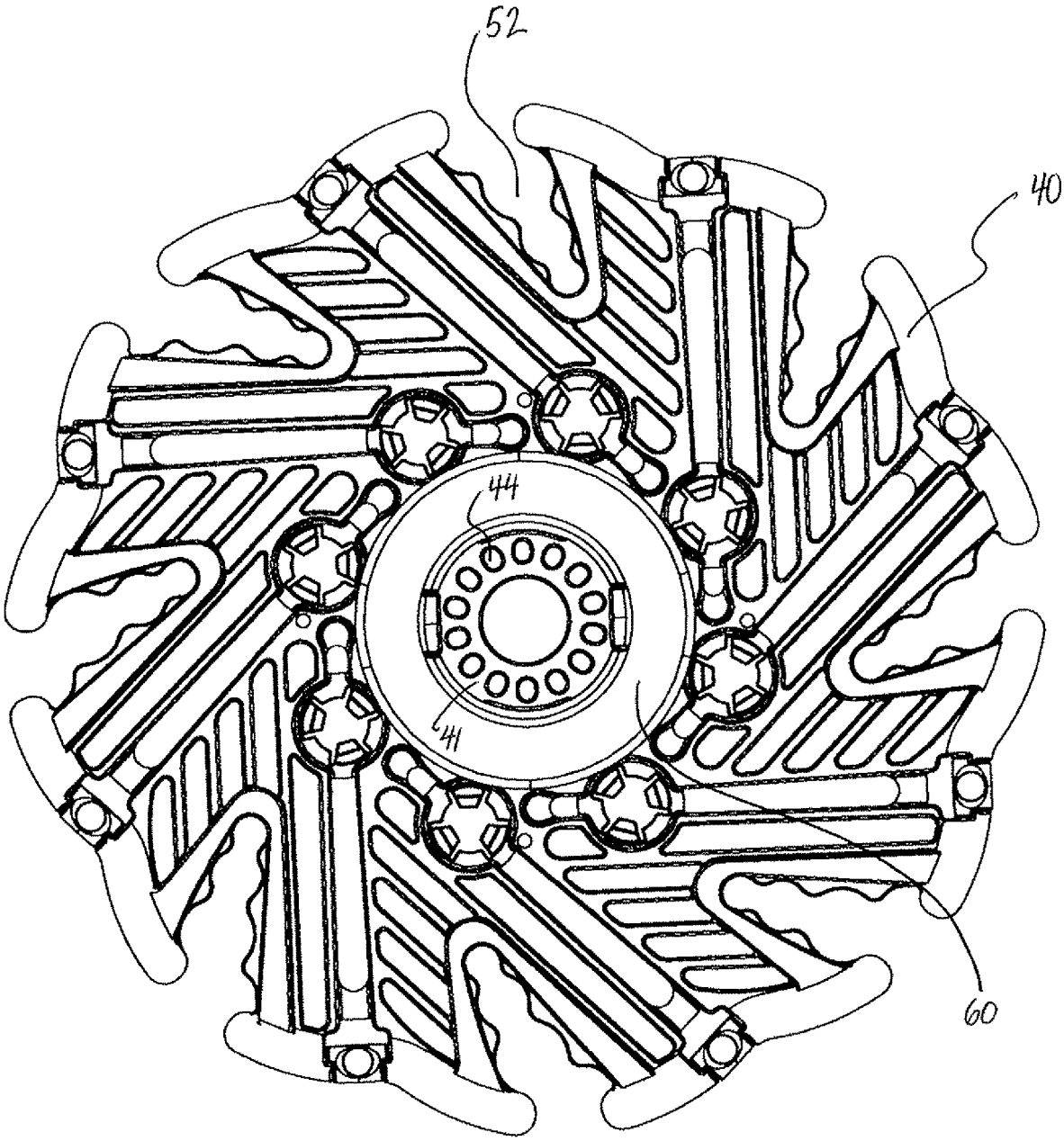
FIG. 11 shows a top view of the utensil bin and top drying rack.

FIGS. 9-10 depict front and side views, respectively, of the top drying rack 40 and utensil bin 60. The top drying rack 40 may comprise a center support 41 upon which the utensil bin 60 rests. As shown in top view FIG. 11, the center support 41 may include apertures 44 which allow liquid to drain from the stored utensils. The center support 41 may be constructed to elevate the utensil bin 60 slightly upward away from the plane of the top drying rack 40 to allow the incorporation of drainage holes therein.

FIGS. 12-13 illustrate exploded views of the top drying rack 40 and utensil bin 60. The utensil bin 60 may be attached to the top drying rack 40 with the locking tabs 62 which are adapted to fit into slots 46*a* in the center support 41 of the top drying rack 40. The locking tabs 62 may be long enough to be accessible from an underside 41*a* of the center support 41. To release the utensil bin 60 from the top drying rack 40, the user would push the locking tab 62 and unalign it from its locked position. The utensil bin 60 may also comprise at least one guide projection 64 which fit into other slots 46*b*. The locking tabs 62 and guide projections 64, alone and in combination, keep the utensil bin 60 secure to the top drying rack 40.

Figure 14:
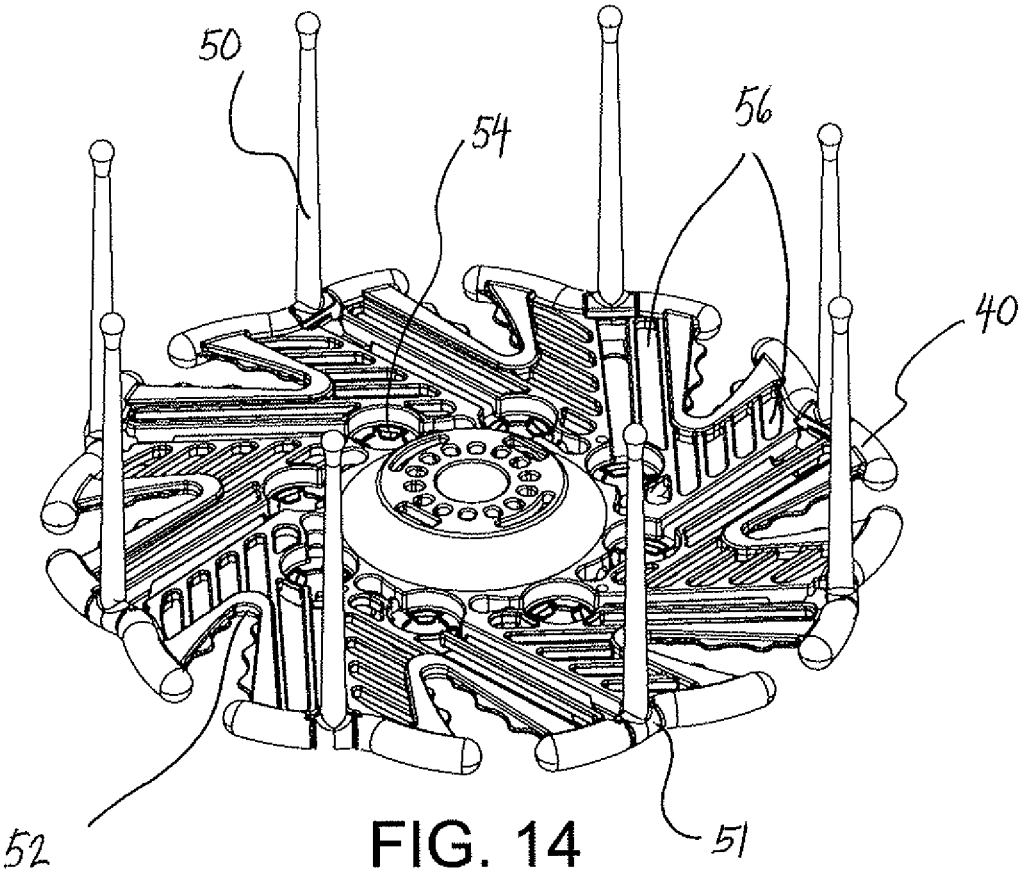
FIGS. 14-15 show upper perspective views of the top drying rack.
Figure 15:
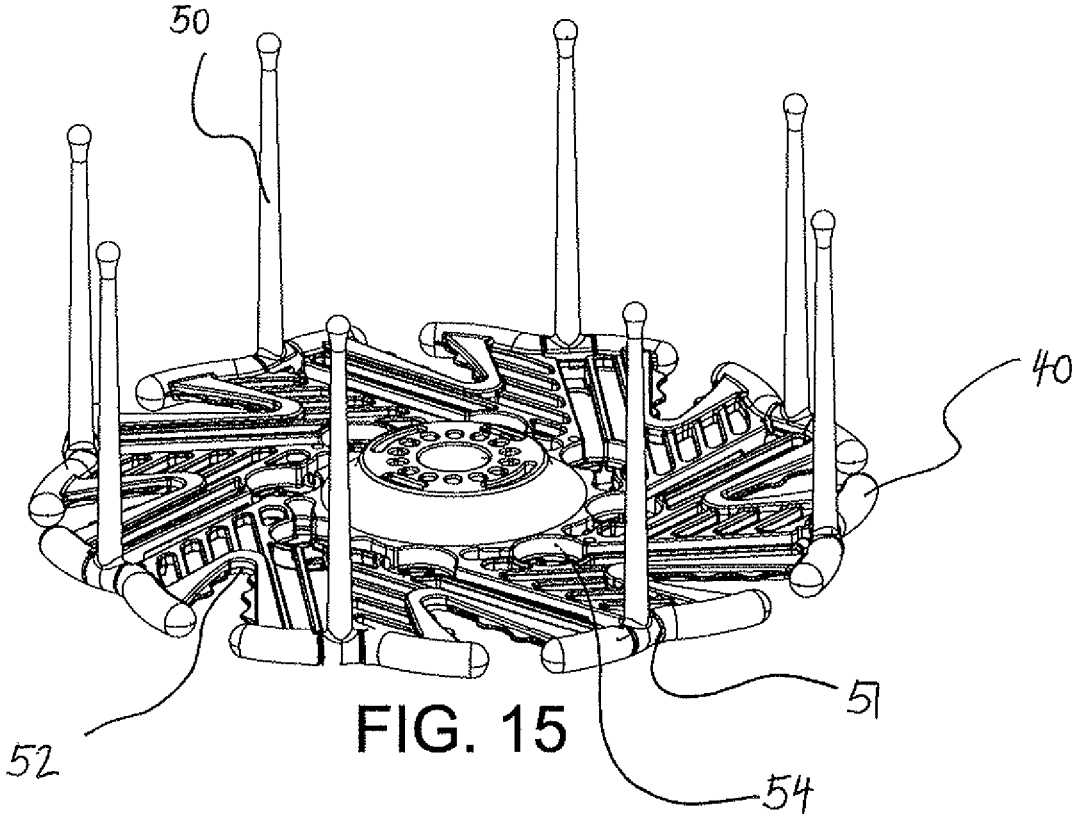
Figure 19:
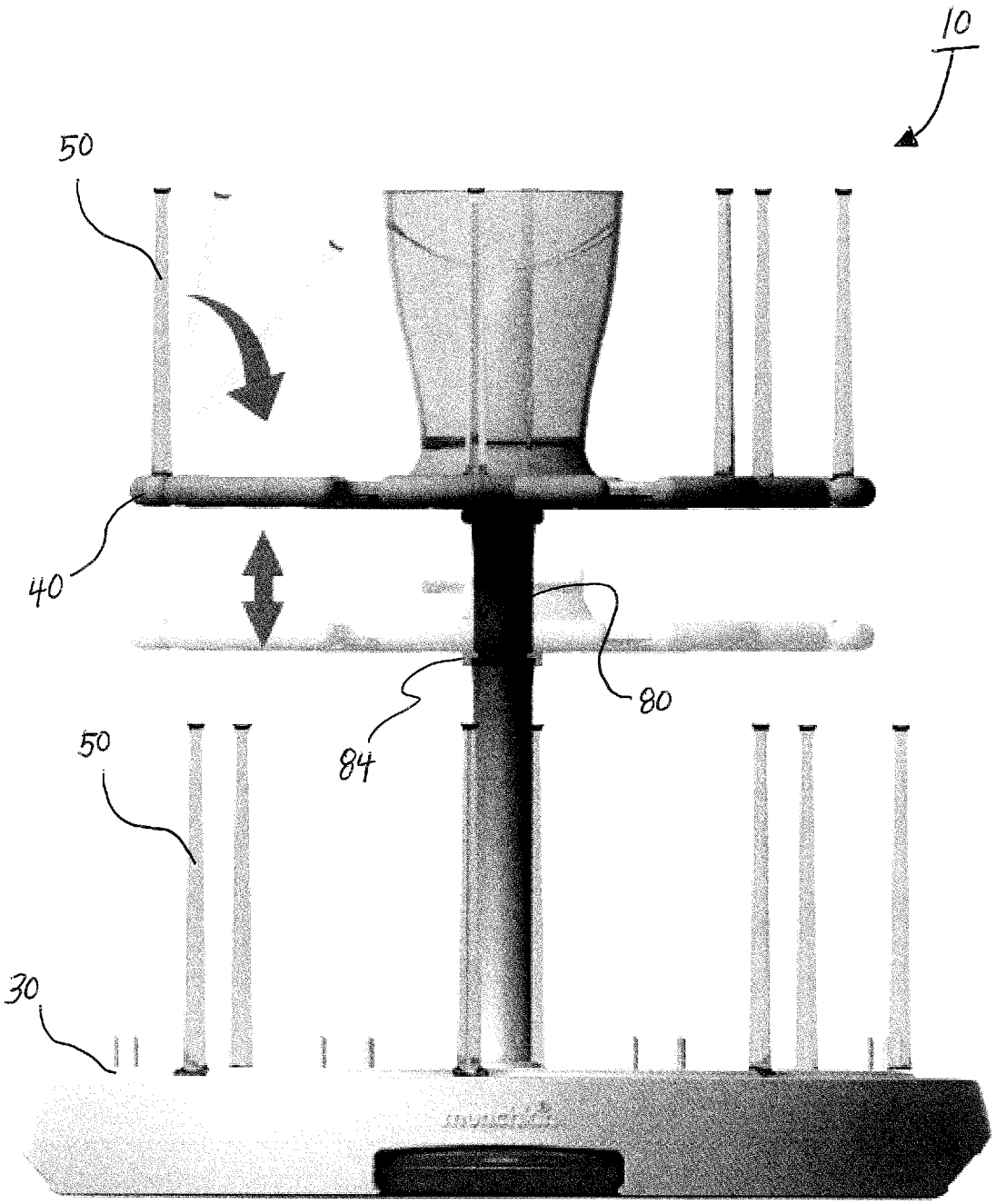
FIG. 19 depicts the top drying rack having foldable pegs and height adjusting mechanism.

FIGS. 14-17 show various views of the top drying rack 40. The top drying rack 40 may include at least one collapsible drying peg 50, clamp 52, straw holder 54, and drainage apertures 56. Drying pegs 50 may be positioned upright, as shown in FIGS. 14-15, or may be pivoted about a hinge 50 (as shown in FIG. 19) to various angles for custom set up and easy storage. In their upright position, the drying pegs 50 may slide into openings in various bottles, lids, collars, etc. to hold them in place while drying. In their stored position, the drying pegs are substantially flush with a top surface located the top drying rack 40 to provide a substantially flat surface area. In addition, the drying pegs 50 may be located circumferentially around the top drying rack 40 and bottom drying rack 30, as shown in FIGS. 14-17.

Figure 16:
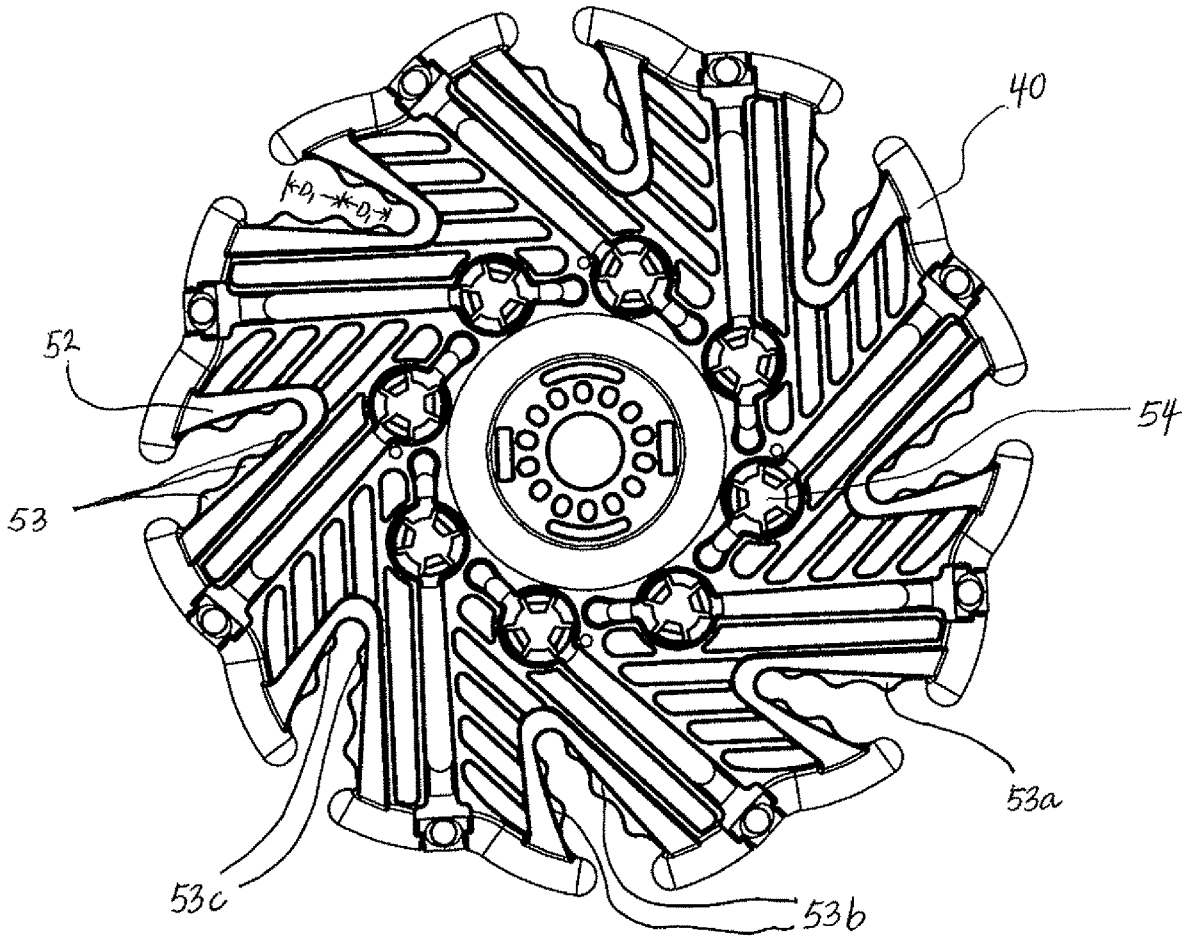
FIG. 16 depicts a top view of the top drying rack.
Figure 17:
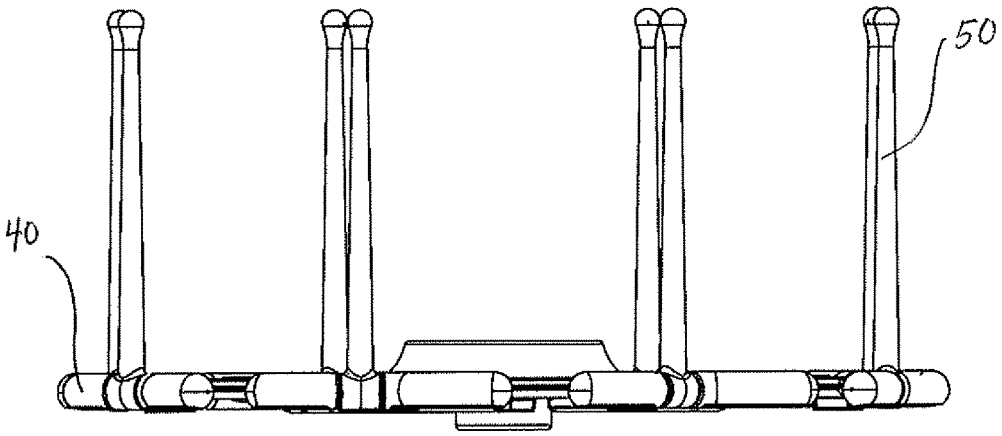
FIG. 17 illustrates a front view of the top drying rack.
Figure 18:
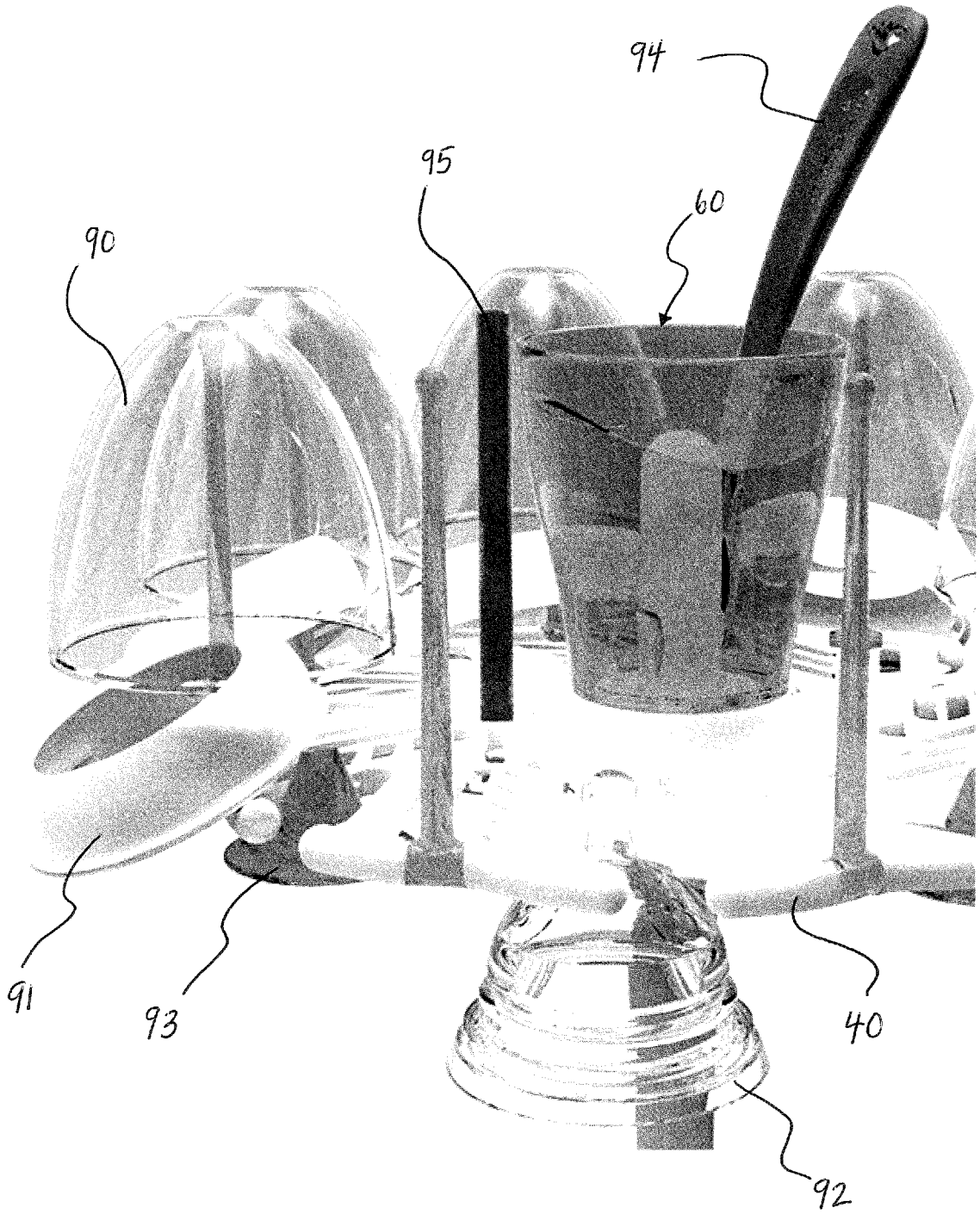
FIG. 18 shows the utensil bin and top drying rack holding various bottle components and accessories.

FIG. 16 shows the clamps 52 and straw holders 54 in greater detail. The clamp 52 is used to secure items into place or provide rugged edges for items to drape over for drying. The clamp 52 may have various sized and shaped undulating indentations, slopes, curvatures, scallops, and teeth 53 or inward projections which project inward from outer edges 52*a* of the clamp 52 defined within the top drying rack 40. The teeth 53 depress various flexible items such as nipples and valves in order to securely grip the item while drying, such as shown in FIG. 18. As shown, the teeth 53 may take on various sized teeth 53*a*, 53*b*, 53*c* which will allow a user to dry both nipples and valves of various diameters.

The distance D1 (as shown in FIG. 16) between adjacent teeth 53 may decrease from adjacent teeth 53*a* located near an opening 52*b* of the clamp 52 to adjacent teeth 53*c* located near a closed back 52*c*. This provides the additional advantage of allowing a user to push the nipple or valve into the opening 52*b*, past adjacent teeth 53 which are too far spaced apart, until the item is sufficiently secured without needing to consciously select which teeth 53 to place the item between.

FIG. 18 depicts the top drying rack 40 and utensil bin 60 in use, holding lids 90, collars 91, nipple 92, valve 93, spoon 94 and straw 95. As previously mentioned, the orientation of these items is important to facilitate effective drying. For example, if the nipple 92 is supported upside down, liquid will pool and not evaporate. By distancing the top drying rack 40 from the bottom drying rack 30 and base 20, items such as the nipple 92 and valve 93 may be supported in an upright position which allows liquid to completely drain from any inner crevices or recesses. Drying pegs 50 provide a similar function for lids 90 and collars 91.

FIG. 19 shows the pivoting rotation of drying pegs 50 and the height adjustment mechanism 80 in greater detail. The drying pegs 50 may be rotated such that they are substantially flush with the top drying rack 40 or bottom drying rack 30. When completely disassembled, the overall height of the base 20, bottom drying rack 30, top drying rack 40 and support 80 may be minimized for effective storage and transportation of the drying rack assembly 10. Furthermore, the top drying rack 40 may be adjusted in use by the push tabs 84 as previously discussed and illustrated by FIGS. 6-7.

Figure 20:
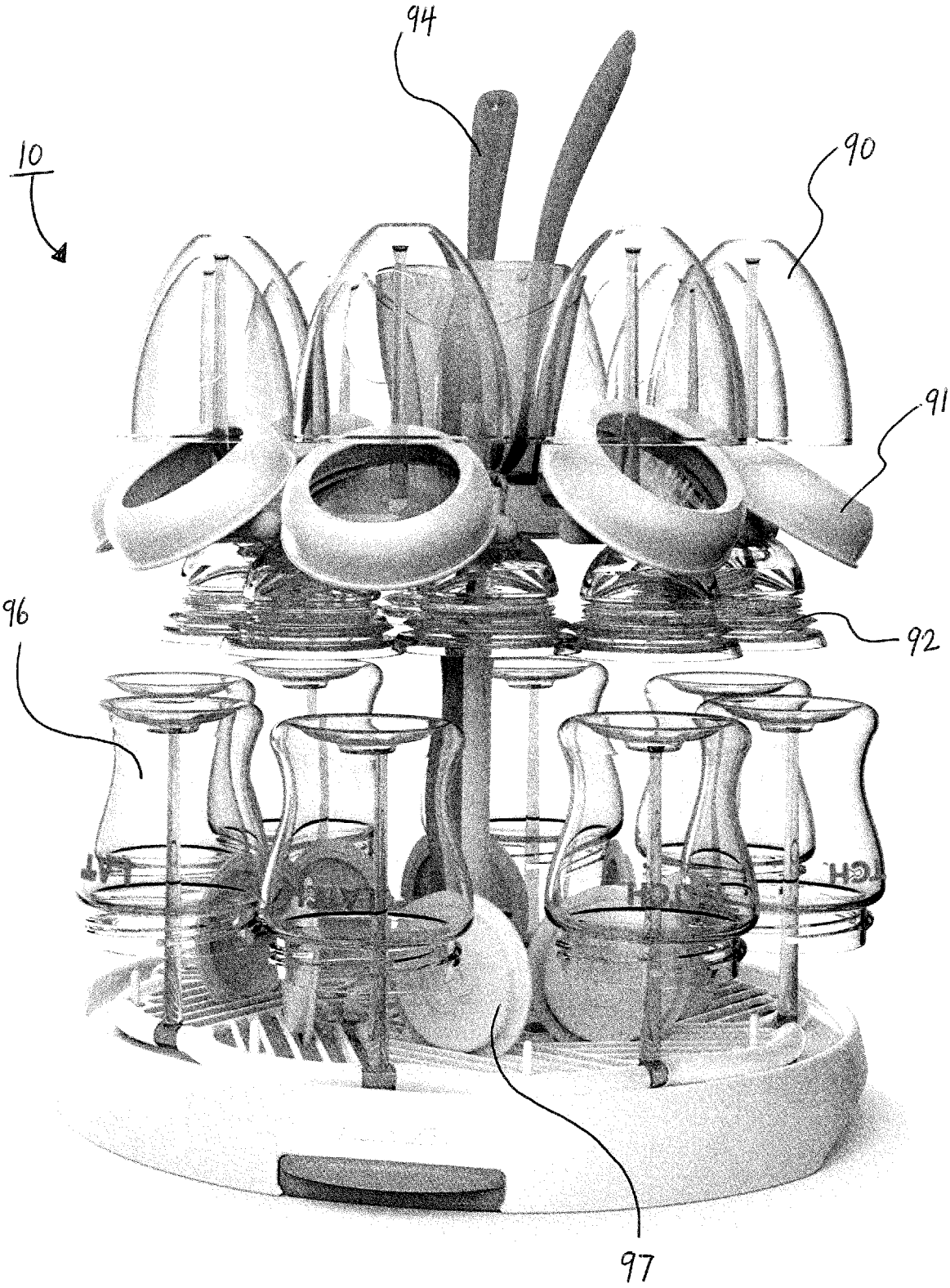
FIG. 20 illustrates the drying rack assembly holding various bottle components and accessories.

FIG. 20 illustrates the drying rack assembly 10 in use for drying lids 90, collars 91, bottles 96, nipples 92, spoons 94 and plates 97.

Figure 21:
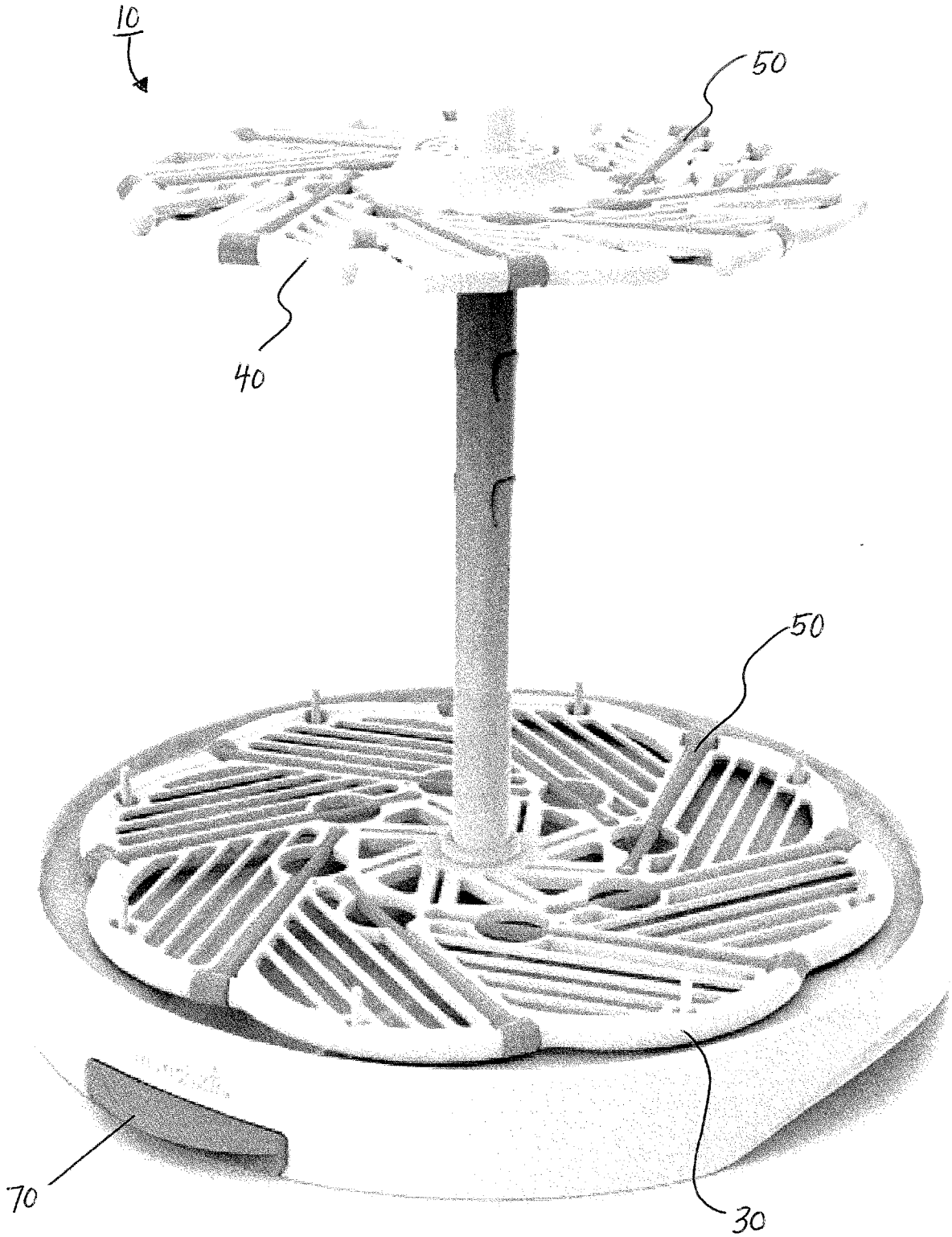
FIG. 21 shows the drying rack assembly having a reversible drip tray in a closed configuration.
Figure 22:
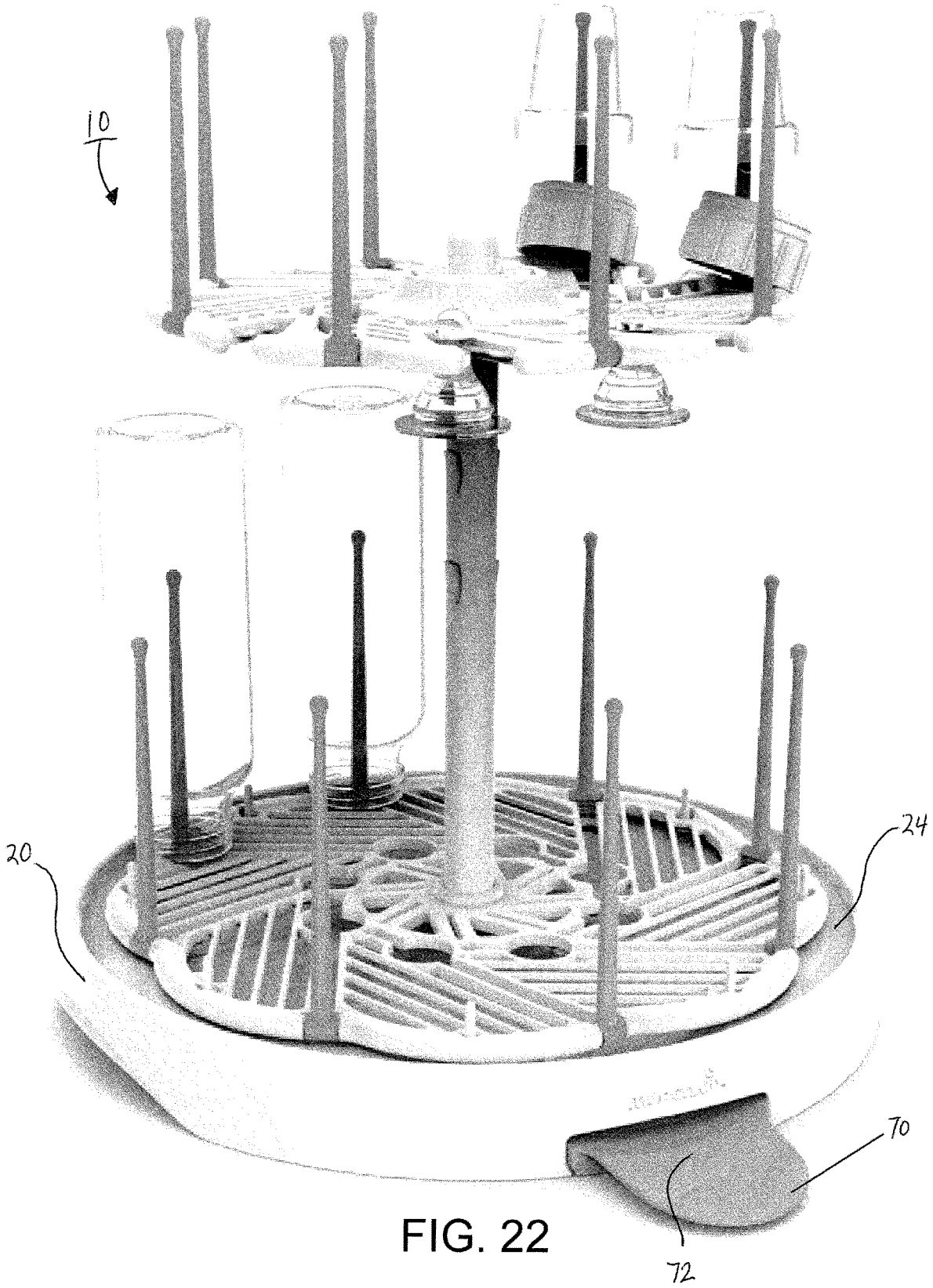
FIG. 22 depicts the drying rack assembly with the reversible drip tray in an open configuration.

FIG. 21 depicts the drying rack assembly 10 having drying pegs 50 and reversible drip tray 70 in a closed position. The drying pegs 50 are shown recessed substantially flush with an upper surface of the drying rack 30. In juxtaposition, FIG. 22 shows the drying pegs 50 and reversible drip tray 70 in an open position. The reversible drip tray 70 may include a ramp 72 having a predetermined direction which, when in the open position, will act as a guide to drain water from the top surface 24 of the base 20 into a sink or other drain. The ramp 72 may include raised edges or may be slightly concave. To change the reversible drip tray 72 from the open to closed position, or vice versa, the reversible drip tray 72 may include tracks 76 which run along rails 29 (as shown in FIG. 7). A front side 72*a* may completely block the aperture 26 in the base 20 and include a lip 71 to allow the user to easily pull the reversible drip tray 70 from the base 20. A back side 72*b* may include the ramp 72 and allow liquid to flow from the top surface 24 down the ramp 72.

The reversible drip tray 70 may also consist of the ramp 72 which pivots along an edge of the base 20. In this manner, when the ramp 72 is exposed it will allow liquid to drain. However, when the ramp 72 is rotated underneath the base 20, the reversible drip tray 70 may block the aperture 26 to prevent liquid from escaping from the top surface 24.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. A drying rack assembly, comprising:

a first drying rack having at least one collapsible peg that stands upright in operation, the first drying rack having at least one open integral clamp with inward projections, wherein the collapsible peg is substantially flushed with an upper surface of the first drying rack in a closed position;

a utensil bin;

a support connecting the utensil bin to the first drying rack; and an elevated foundation connected to the first drying rack to provide air ventilation.

2. The drying rack assembly as recited in claim 1, wherein the inward projections are disposed along an inner edge of the clamp to secure at least one object to the first drying rack.

3. The drying rack assembly as recited in claim 1, wherein in the drying rack assembly further comprises:

a second drying rack;

a height adjustable mechanism on the elevated foundation to vary the distance between the second drying rack and the first drying rack; and a base connected to the elevated foundation.

4. The drying rack assembly as recited in claim 3, wherein the base includes at least one drain aperture on a top surface of the base.

5. The drying rack assembly as recited in claim 4, wherein the base further comprises a reversible drip tray which allows liquid to drain from the top surface of the base through the drain aperture.

6. The drying rack assembly as recited in claim 5, wherein the reversible drip tray collects liquid in an open position and allows liquid to drain out in a predetermined direction away from the base.

7. The drying rack assembly as recited in claim 1, wherein the utensil bin is frustoconically shaped having an open top to provide easy access to an object contained therein.

8. The drying rack assembly as recited in claim 1, wherein the support has at least one aperture to allow liquid to drain out from the utensil bin.

9. The drying rack assembly as recited in claim 1, wherein the support has a slot adapted to receive a projection connected to the utensil bin thereby creating a friction fit.

10. A drying rack assembly, comprising:

a base;

a first drying rack connected to the base having at least one collapsible peg that stands upright in operation;

a second drying rack having a utensil bin, at least one collapsible peg that stands upright in operation, the second drying rack having at least one open integral clamp with inward projections; and a height adjustable mechanism that connects the base and the second drying rack, wherein the height adjustable mechanism varies the distance between the first drying rack and the second drying rack.

11. The drying rack assembly as recited in claim 10, wherein the inward projections are disposed along an inner edge of the clamp to secure an object to the drying rack assembly.

12. The drying rack assembly as recited in claim 10, wherein the drying rack assembly can freely spin about the height adjustable mechanism.

13. The drying rack assembly as recited in claim 10, wherein the collapsible peg is flush with a top surface of the drying rack assembly when in a closed position.

14. A drying rack assembly, comprising:

a base;

an open integral clamp with inward projections;

a lower drying rack connected to the base and having at least one collapsible peg that stands upright in operation;

an upper drying rack having a utensil bin and at least one collapsible peg that stands upright in operation; and a height adjustable mechanism that connects the base and the upper drying rack, wherein the height adjustable mechanism varies the distance between the lower drying rack and the upper drying rack.

15. The drying rack assembly as recited in claim 14, wherein the inward projections are disposed along an inner edge of the clamp to secure an object to the drying rack assembly.

16. The drying rack assembly as recited in claim 14, wherein the utensil bin has at least one aperture for draining liquids.

* * * * *